United States Patent [19]

Drenner

[11] 4,386,588

[45] Jun. 7, 1983

[54] CANISTER RETAINER ASSEMBLY

[75] Inventor: David D. Drenner, Parkersburg, Iowa

[73] Assignee: Deere & Company, Moline, Ill.

[21] Appl. No.: 172,365

[22] Filed: Jul. 25, 1980

[51] Int. Cl.[3] ..... F02M 1/16

[52] U.S. Cl. ..... 123/187.5 R

[58] Field of Search ..... 123/187.5 R, 180 R, 123/180 E, 180 AR, 198 A

[56] References Cited

U.S. PATENT DOCUMENTS

| | | | |
|---|---|---|---|
| 2,704,536 | 3/1955 | Edwards | 123/187.5 R |
| 2,708,922 | 5/1955 | Neely | 13/18 7.5 R |
| 2,995,127 | 8/1961 | Orr | 123/187.5 R |
| 3,661,133 | 5/1972 | Rasch | 123/187.5 R |

FOREIGN PATENT DOCUMENTS

| | | | |
|---|---|---|---|
| 644 | of 1896 | United Kingdom | 123/180 R |

*Primary Examiner*—Craig R. Feinberg

[57] ABSTRACT

This invention relates to a canister retainer assemby for holding an aerosol canister of starting fluid in an upright position against a mechanical or an electrical valve. This canister retainer assembly is comprised of an adapter and a canister holder. The adapter is securely attached at one end to the mechanical or electrical valve and is opened at the other end. Located near the open end of the adapter is an attachment means, such as internal threads. The canister holder, which is comprised of a hollow tubular member with an open end and a closed end, is designed to be joined to the adapter by external attachment means. Such an assembly is capable of both holding an aerosol canister in an upright position against a diesel engine and of being inverted to seal off the inlet opening of the mechanical or electrical valve when no canister is present.

3 Claims, 6 Drawing Figures

CANISTER RETAINER ASSEMBLY

BACKGROUND OF THE INVENTION

1. Field of the Invention

This invention relates to a canister retainer assembly for holding a canister of starting fluid and more particularly to a canister retainer assembly for holding a canister of starting fluid in an upright position against an electric solenoid valve which is mounted on a diesel engine.

2. Description of the Prior Art

Today a large number of vehicles having diesel engines, including agricultural and industrial type tractors, use canisters of starting fluid to aid them in starting, especially during periods of cold weather. Such canisters are normally mounted on the side of the engine in an upright position and are attached to an electric solenoid valve. The electric solenoid valve contains a plunger associated therewith for releasing the starting fluid out of the canister and into the engine.

Currently, many such canisters are retained in place by a bale assembly. This bale assembly includes a U-shaped metal strap which is pivotally attached at its open ends to the solenoid valve. A threaded stud is fastened to the bottom of the U-shaped strap and is attached to a frustoconical cup. The frustoconical cup raises the canister into the sealed position by being rotated counterclockwise. Such bale assemblies have proved unsatisfactory for a number of reasons. First, the bales do not always retain the canister of starting fluid in an upright position because the bales tend to become misaligned as a result of being improperly manufactured or assembled. Second, as the operator tightens the frustoconical cup in place, he actually causes the canister to become misaligned against a sealing gasket located on the solenoid valve. This causes the starting fluid to leak from the canister thereby draining out all of the starting fluid. And lastly, frozen dirt, water and moisture tend to freeze to the threaded stud inside the frustoconical cup and this prevents the cup from being unscrewed when it is necessary to replace the canister. These and other problems are overcome by the present invention.

The general object of this invention is to provide a canister retainer assembly for holding a canister of starting fluid. A more specific object of this invention is to provide a canister retainer assembly for holding a canister of starting fluid in an upright position against a mechanical valve or an electric solenoid valve associated with a diesel engine.

Another object of this invention is to provide a canister retainer assembly which will seal the intake opening of a mechanical or an electrical valve when no canister is being held in place.

Still another object of this invention is to provide a canister retainer assembly which is less costly and easier to service than existing assemblies.

A further object of this invention is to provide a canister retainer assembly which is visually more attractive.

Still further, an object of this invention is to provide a canister retainer assembly which will maintain proper canister alignment.

Other objects and advantages of the present invention will become more apparent when considered in connection with the specification and the drawings.

SUMMARY OF THE INVENTION

Briefly, this invention relates to a canister retainer assembly for holding a canister of starting fluid in a upright position against a mechanical or an electrical valve associated with a diesel engine. Such an assembly is comprised of two parts: an adapter and a canister holder. The adapter, which is securely attached to the valve, for example, an electric solenoid valve, is a collar-shaped device which is open at both ends. The upper end is sealably attached to the electric solenoid valve and forms a closed cap while the bottom end is open for receiving the canister holder. Located on an inner surface of the adapter are attachment means such as helical threads. These attachment means engage with external attachment means located on the canister holder for holding it in place. The canister holder is a hollow, cylindrically-shaped member having an open end and a closed end. The externally positioned attachment means are located approximately an equal distance from both of the ends.

This canister retainer assembly is designed to serve two purposes. The first is that it provides a means for holding a canister of starting fluid in an upright position to a mechanical or an electrical valve which is mounted on a diesel engine. And second, the canister retainer assembly can seal off the intake orifice of the valve when no canister is present. This is accomplished by inverting the canister holder and inserting it into the closed end of the adapter.

DETAILED DESCRIPTION OF THE INVENTION

Figure 1:
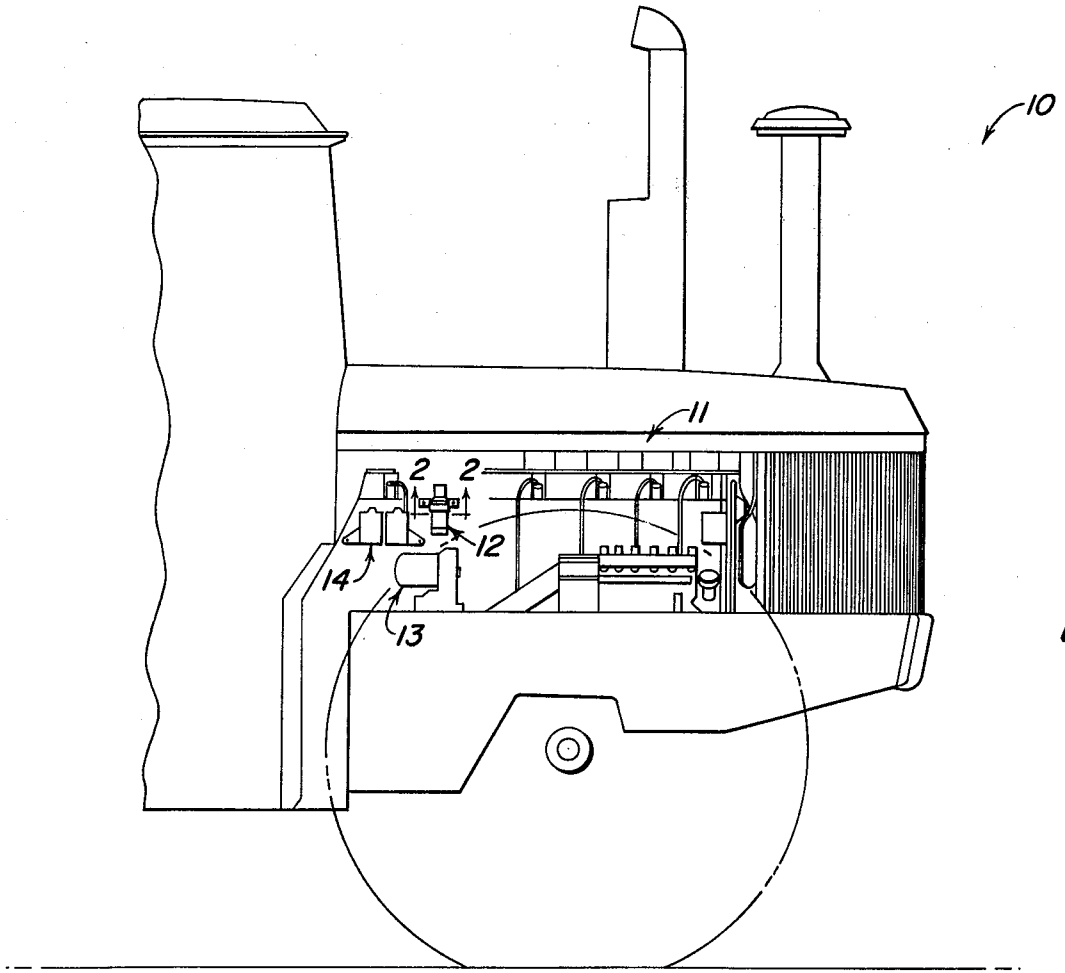
FIG. 1 is a partial side view of a tractor showing the canister retainer assembly mounted to the engine.

FIG. 1 shows a vehicle 10 powered by a diesel or gasoline engine 11. Mounted to this engine 11 is a canister retainer assembly 12 which is designed to support an aerosol canister of starting fluid, such as ethyl ether. The starting fluid in the canister is injected into the intake manifold of the engine 11 to assist in starting, especially during periods of cold weather. Currently, such canister retainer assemblies 12 are utilized on most agricultural and industrial type diesel tractors. A typical place to mount such an assembly 12 is above the oil filter 13 and just forward of the fuel filters 14. The exact location of the canister retainer assembly 12 can vary but preferably it is positioned close to the intake manifold (not shown).

Figure 2:
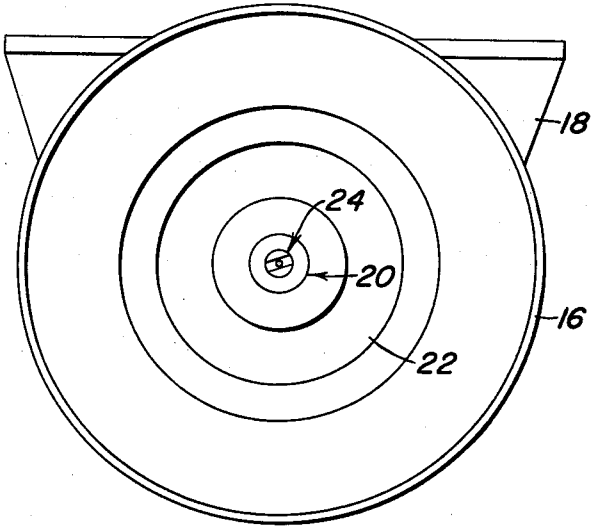
FIG. 2 is an enlarged view of FIG. 1 as seen along line 2—2.

Referring now to FIG. 2, a typical electric solenoid valve 16 is shown with an attached mounting bracket 18 for attachment to the engine 11. This electric solenoid valve 16 contains an inlet opening 20 surrounded by a flexible gasket 22. Located within the inlet opening 20 is a movable plunger 24 which is activated by a mechanical, an electrical or an electromagnetic device. For example, the electric solenoid valve 16 can contain a coil winding which when charged would cause the plunger to move in one direction. A return spring, not shown, could then be utilized to return the plunger 24 to its initial position. The movable plunger 24 is designed to impinge on an outlet valve 26 shown in FIG. 3 which is located on the top of a canister of starting fluid 28. When this outlet valve 26 is depressed downward, it allows the starting fluid, for example, ethyl ether, to exit the canister 28 and be routed through the electric solenoid valve 16 to the intake manifold. A small orifice in the intake manifold then aids in vaporizing the liquid ether before it is distributed to the combustion chambers of the engine 11.

The canister retainer assembly 12 is comprised of two principal parts, an adapter 30 and a canister holder 32. The adapter 30 is securely attached at one end to the electric solenoid valve 16 and provides a means onto which the canister holder 32 can be removably attached. Preferably, the adapter 30, which is collar-shaped in construction, is sealably attached, such as by spin welding, to the bottom of the electric solenoid valve 16. Located at the opposite or bottom end of the adapter 30 is an opening 33 which receives the canister holder 32. The canister holder 32 normally retains the aerosol canister 28 in an upright position. This upright position is necessary for correct operation because the aerosol canister 28 contains both a propellant and a quantity of ethyl ether. If the aerosol canister 28 is tilted or positioned sideways, it may only deliver the lighter constituent propellant to the engine 11 instead of the ethyl ether. This is not desirable for the propellant may not be ignitible.

Located approximate the opening 33 of the adapter 30 is an attachment means 34. This attachment means 34 can be any type of fastener including threads. Preferably, when threads are employed, they are either screw or bayonet threads.

Figure 4:
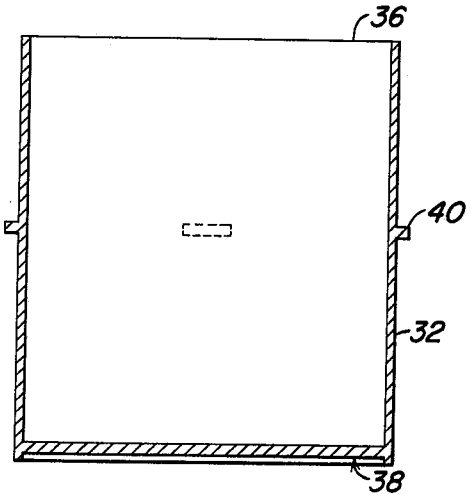
FIG. 4 is a sectional view of only the canister holder shown in FIG. 3.

The canister holder 32, better seen in FIG. 4, is a hollow, cylindrical member having an open end 36 and a closed end 38. Preferably the closed end 38 is flat in construction. Located between these two ends 36 and 38, is an external attachment means 40 which joins the canister holder 32 to the adapter 30. As shown, the attachment means 40 contains a plurality of individual tongues which engage with the internal attachment means 34 located on the adapter 30.

Returning again to FIG. 3, it is noticed that the canister holder 32 is designed to hold an aerosol canister 28 in an upright position to the electric solenoid valve 16. In so doing, the outlet valve 26 on the aerosol canister 28 will be inserted into a portion of the inlet opening 20. In addition, the flexible gasket 22, which surrounds the inlet opening 20, will abut a top portion of the canister 28 and form a tight fit.

The canister retainer assembly 12 is designed to serve a dual function. First, it is capable of holding an aerosol canister 28 in an upright position on an engine 11 and second, it is capable of sealing the inlet opening 20 when no aerosol canister 28 is present. This is accomplished by inverting the canister holder 32 and inserting it into the adapter 30 with the bottom surface 38 being the uppermost surface. The seal is then formed by the external attachment means 40 engaging the internal attachment means 34.

Figure 6:
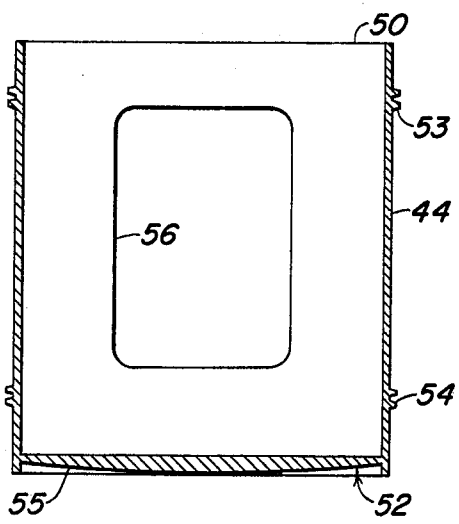
FIG. 6 is a sectional view of only the canister holder shown in FIG. 5.
Figure 5:
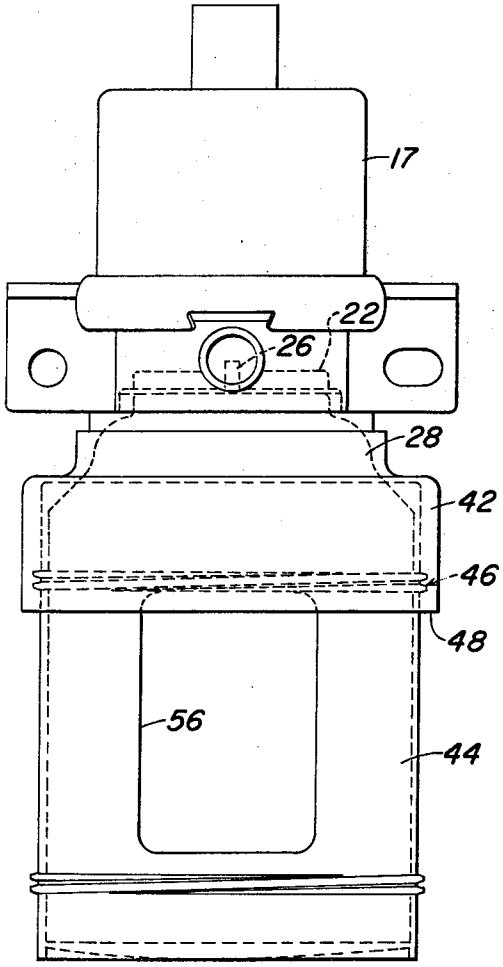
FIG. 5 is a side view of a second embodiment of the canister retainer assembly attached to a mechanical valve.
Figure 2:
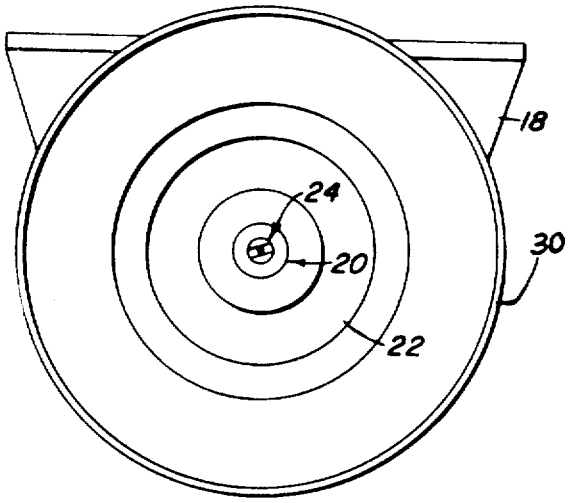
Figure 3:
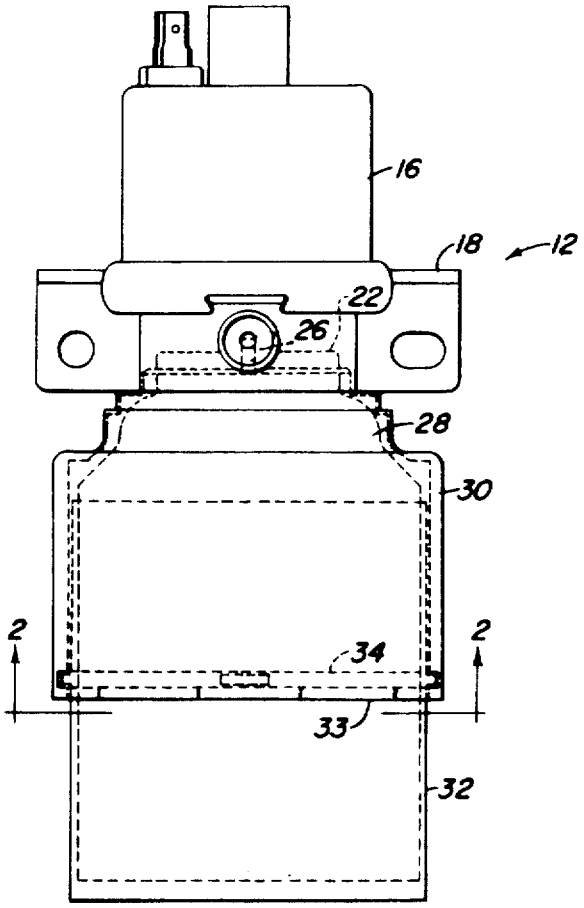

Referring now to FIGS. 5 and 6, a second embodiment of the canister retainer assembly 12 is shown. In this embodiment, a shorter adapter 42, connected to a mechanical valve 17, is utilized in conjunction with a different configuration of canister holder 44. The shorter adapter 42 is similar to the adapter 30, wherein it contains an internal attachment means 46 positioned close to an opening 48. Designed to engage with this internal attachment means 46 is the canister holder 44. This canister holder 44 contains an open end 50, a closed end 52 and a plurality of spaced apart attachment means 53 and 54, see FIG. 6. The attachment means 53 and 54 can be any suitable type of fastener, including threads, such as those described earlier.

The canister holder 44 can also be inverted to satisfy its dual function, but in this design the closed end 52 has a convex outer surface 55. The convex surface 55 can aid in sealing off the inlet opening of the mechanical valve 17. Furthermore, in this second embodiment, when the attachment means 53 and 54 are external threads, both have to be either right-handed or left-handed so as to be engageable with the adapter 42 even when the canister holder 44 is inverted.

The canister 44 also has openings 56 positioned on its periphery. These peripheral openings 56 allow the operator of the vehicle to view the aerosol canister 28 and also aid him in grasping the canister holder 44 in order to rotate it. This grasping feature is desirable during the threading or unthreading process. One or more peripheral openings 56 can be positioned on the periphery of the canister holder 44. Their exact location, number and size can vary but preferably, they are of sufficient size to allow the operator to position his fingers on them.

While the invention has been described in conjunction with two specific embodiments, it is to be understood that many alternatives, modifications and variations will be apparent to those skilled in the art in light of the foregoing description. Accordingly, this invention is intended to embrace all such alternatives, modifications and variations which fall within the spirit and scope of the appended claims.

I claim:

1. A canister retainer assembly capable of holding an aerosol canister in an upright position against an electric solenoid valve associated with an engine and of sealing said electric solenoid valve from outside air when no canister is present, said electric solenoid valve including an inlet opening, a rubberized gasket surrounding said inlet opening, a plunger movably positioned within said inlet opening, and means for activating said plunger to contact an outlet valve located in the top of said aerosol canister to thereby release pressurized fluid from said aerosol canister, said assembly comprising:

(a) a collar-shaped adapter secured to said electric solenoid valve which has an end surface with an opening therein, said adapter further having a 360 degree circular groove formed on an inner circumferential surface which is aligned adjacent to said opening; and (b) a holder having a hollow cylindrical body which is opened at one end and closed at a second end, and having a plurality of outwardly extending members arranged on the outer circumference of said holder in an equally spaced-apart configuration and lying in a plane aligned perpendicular to the elongated axis of said cylindrical body, said members being engageable with said circular groove to position said holder in a first position wherein said holder is capable of retaining said aeeosol canister is an upright position against said electric solenoid valve with said one end in contact with said adapter therewithin and being reversably engageable with said circular groove to position said holder in a second position wherein said holder in inverted 180 degrees to seal said electric solenoid valve from contamination when no aerosol canister is present and with said second end in contact with said adapter therewithin.

2. The canister assembly of claim 1 wherein said plurality of outwardly extending members includes four tabs positioned 90 degrees apart.

3. The canister assembly of claim 2 wherein said tabs are located an equal distance from both said open and closed ends of said holder.

* * * * *

UNITED STATES PATENT AND TRADEMARK OFFICE

CERTIFICATE OF CORRECTION

PATENT NO. : 4,386,588 Page 1 of 2

DATED : June 7, 1983

INVENTOR(S) : David D. Drenner

Figure 3:
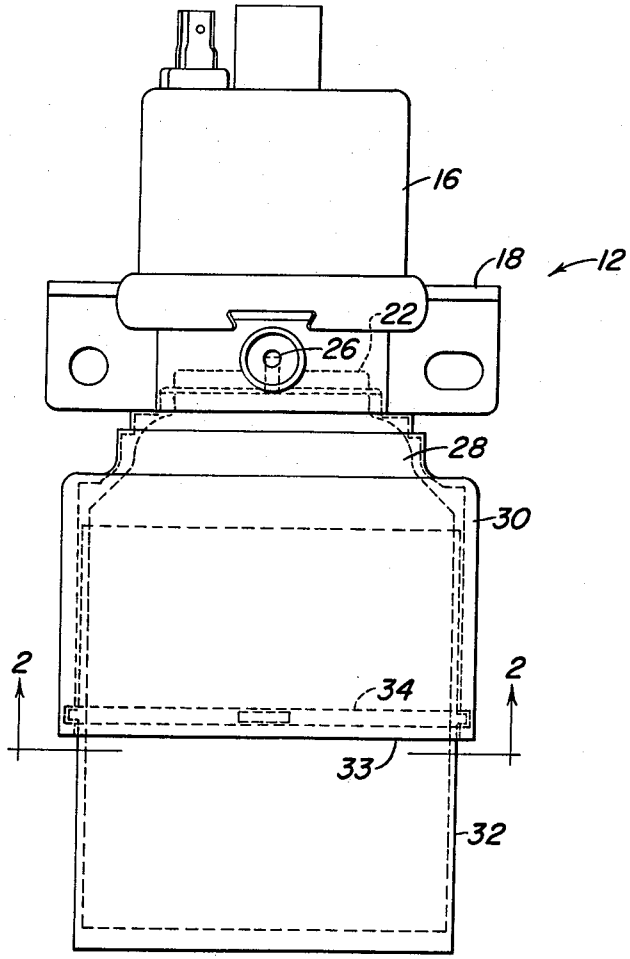
FIG. 3 is a side view of one embodiment of the canister retainer assembly attached to an electric solenoid valve.

It is certified that error appears in the above-identified patent and that said Letters Patent is hereby corrected as shown below:

Figures 2 and 3 of the drawing should be deleted to appear as per attached sheet.

Column 5, line 2, delete "is" and insert -- in --; line 7, delete "in" and insert -- is --.

Signed and Sealed this

*Twenty-sixth* Day of *February 1985*

[SEAL]

*Attest:*

DONALD J. QUIGG

*Attesting Officer* *Acting Commissioner of Patents and Trademarks*